US010119546B2

(12) United States Patent
Masutani et al.

(10) Patent No.: US 10,119,546 B2
(45) Date of Patent: Nov. 6, 2018

(54) ROTARY MACHINE

(71) Applicant: MITSUBISHI HEAVY INDUSTRIES COMPRESSOR CORPORATION, Tokyo (JP)

(72) Inventors: Jo Masutani, Tokyo (JP); Satoru Yoshida, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 490 days.

(21) Appl. No.: 14/658,627

(22) Filed: Mar. 16, 2015

(65) Prior Publication Data

US 2015/0184664 A1 Jul. 2, 2015

Related U.S. Application Data

(62) Division of application No. 14/377,011, filed as application No. PCT/JP2012/054734 on Feb. 27, 2012.

(51) Int. Cl.
*F04D 17/12* (2006.01)
*F04D 29/42* (2006.01)
(Continued)

(52) U.S. Cl.
CPC ..... *F04D 17/12* (2013.01); *F04D 17/122* (2013.01); *F04D 29/4206* (2013.01);
(Continued)

(58) Field of Classification Search
CPC .... F04D 17/12; F04D 17/122; F04D 29/4206; F04D 29/4213; F04D 29/441; F04D 29/444
See application file for complete search history.

(56) References Cited

U.S. PATENT DOCUMENTS 4,354,802 A 10/1982 Nishida et al.
9,163,643 B2 10/2015 Masutani

FOREIGN PATENT DOCUMENTS

CN 101523056 9/2009
CN 102242736 11/2011
(Continued)

OTHER PUBLICATIONS

Office Action dated Oct. 14, 2016 in U.S. Appl. No. 14/377,011.
(Continued)

*Primary Examiner* — Jason Shanske
*Assistant Examiner* — Cameron Corday
(74) *Attorney, Agent, or Firm* — Wenderoth, Lind & Ponack, L.L.P.

(57) ABSTRACT

A rotary machine includes a guide section formed in an annular flow path in communication with a suction volute at an inner circumferential side of the suction volute, at which a plurality of vanes are installed in a circumferential direction, and configured to guide a fluid introduced from the suction volute, and an impeller connected to the guide section in the axial direction and into which the fluid guided by the guide section is introduced, wherein the suction volute has an annular opening section in communication with the guide section at the inner circumferential side, and an inner wall surface extending from the opening section toward the axial direction impeller in the axial direction to increase a width dimension in the axial direction and connected to a partition section at an opposite side of the suction nozzle.

4 Claims, 5 Drawing Sheets

(51) Int. Cl.
*F04D 29/44* (2006.01)
*F04D 29/70* (2006.01)

(52) U.S. Cl.
CPC ..... *F04D 29/4213* (2013.01); *F04D 29/441* (2013.01); *F04D 29/444* (2013.01); *F04D 29/701* (2013.01); *F05D 2250/51* (2013.01)

(56) References Cited

FOREIGN PATENT DOCUMENTS

| | | | |
|---|---|---|---|
| EP | 1 593 854 | 11/2005 | |
| EP | 2 402 618 | 1/2012 | |
| JP | 31-2006 | 3/1956 | |
| JP | 62-59796 | 4/1987 | |
| JP | 05-073296 | 10/1993 | |
| JP | 8-93691 | 4/1996 | |
| JP | 08-232893 | 9/1996 | |
| JP | 2000-87899 | 3/2000 | |
| JP | 2006-233901 | 9/2006 | |
| JP | 2007-309154 | 11/2007 | |
| JP | 2009-62965 | 3/2009 | |
| JP | 2009-174458 | 8/2009 | |
| JP | 2010-203251 | 9/2010 | |
| JP | WO 2010098032 A1 * | 9/2010 | ..... F04D 29/441 |
| JP | 2010-236401 | 10/2010 | |
| JP | 2010-285927 | 12/2010 | |
| JP | 2011-064111 | 3/2011 | |
| JP | 2011-117402 | 6/2011 | |
| SU | 1211419 | 2/1986 | |
| WO | 2010/098032 | 9/2010 | |

OTHER PUBLICATIONS

Extended European Search Report dated Oct. 27, 2015 in European Application No. 12869730.7.

Extended European Search Report dated Oct. 28, 2015 in European Application No. 15163669.3.

Office Action dated Nov. 4, 2015 in Chinese Application No. 201280069492.9 (with English translation of Search Report).

International Search Report dated May 15, 2012 in corresponding International Application No. PCT/JP2012/054734 (with English translation).

Written Opinion of the International Searching Authority dated May 15, 2012 in corresponding International Application No. PCT/JP2012/054734 (with English translation).

Notice of Allowance dated Feb. 3, 2015 in corresponding Japanese Application No. 2012-547348 (with English translation).

Office Action dated May 5, 2017 in U.S. Appl. No. 14/377,011.

* cited by examiner

ROTARY MACHINE

TECHNICAL FIELD

The present invention relates to a rotary machine such as a centrifugal compressor or the like, and more particularly, to reduction in pressure loss of a suction side thereof.

BACKGROUND ART

In Patent Literature 1, in a volute of a centrifugal compressor, in order to increase the flow velocity in an opposite range of a nozzle, a technology of burying a member in the range of the volute and reducing a flow path area is disclosed.

CITATION LIST

Patent Literature

[Patent Literature 1] Japanese Unexamined Patent Application, First Publication No. 2010-203251

SUMMARY OF INVENTION

Technical Problem

Meanwhile, in recent years, in a rotary machine such as a centrifugal compressor or the like, miniaturization of a dimension in a radial direction is desired. When the dimension in the radial direction of the rotary machine such as the centrifugal compressor or the like is miniaturized, a flow path area of the volute cannot be sufficiently secured in a portion introduced from the nozzle into the volute, and there is a tendency of increasing the flow velocity in the entire volute. For this reason, when the fluid is introduced from the volute into the vane, exfoliation or the like may occur to increase the pressure loss, and performance may be degraded.

In consideration of the above-mentioned circumstances, the present invention provides a rotary machine capable of miniaturizing a dimension in a radial direction, suppressing an increase in flow velocity throughout the entire volute to prevent generation of pressure loss or the like, and suppressing a degradation in performance.

Solution to Problem

A first aspect of a rotary machine according to the present invention includes a nozzle configured to introduce a fluid from an outer circumferential side to an inner circumferential side in a radial direction; a volute having a substantially annular space in communication with the nozzle at the outer circumferential side and a partition section configured to separate the space in a circumferential direction at an opposite side from a connection section connected to the nozzle with a central axis sandwiched therebetween; a guide section having a flow path in communication with the volute at the inner circumferential side of the volute, at which a plurality of vanes are installed in the circumferential direction, and configured to guide the fluid introduced from the volute; and an impeller connected to the guide section in the axial direction and into which the fluid guided by the guide section is introduced, wherein the volute includes an annular opening section in communication with the guide section at the inner circumferential side of the volute; and an inner wall surface extending from the opening section toward the impeller in the axial direction to increase the width dimension in the axial direction and connected to the partition section.

In a second aspect of the rotary machine according to the present invention, the volute of the rotary machine of the first aspect may be widened to both sides in the axial direction.

In a third aspect of the rotary machine according to the present invention, the volute of the rotary machine according to the first aspect or the second aspect may have a tapered section formed in a tapered shape at an opposite side of the impeller in the axial direction.

In a fourth aspect of the rotary machine according to the present invention, the volute of the rotary machine of the first aspect or the second aspect may have a wall surface formed in the axial direction at an opposite side of the impeller in the axial direction.

Advantageous Effects of Invention

According to the rotary machine of the present invention, a dimension in the radial direction can be miniaturized and an increase in flow velocity can be suppressed throughout the entire volute to prevent pressure loss or the like, preventing a degradation in performance.

DESCRIPTION OF EMBODIMENTS

Hereinafter, a rotary machine according to an embodiment of the present invention will be described.

Figure 1:
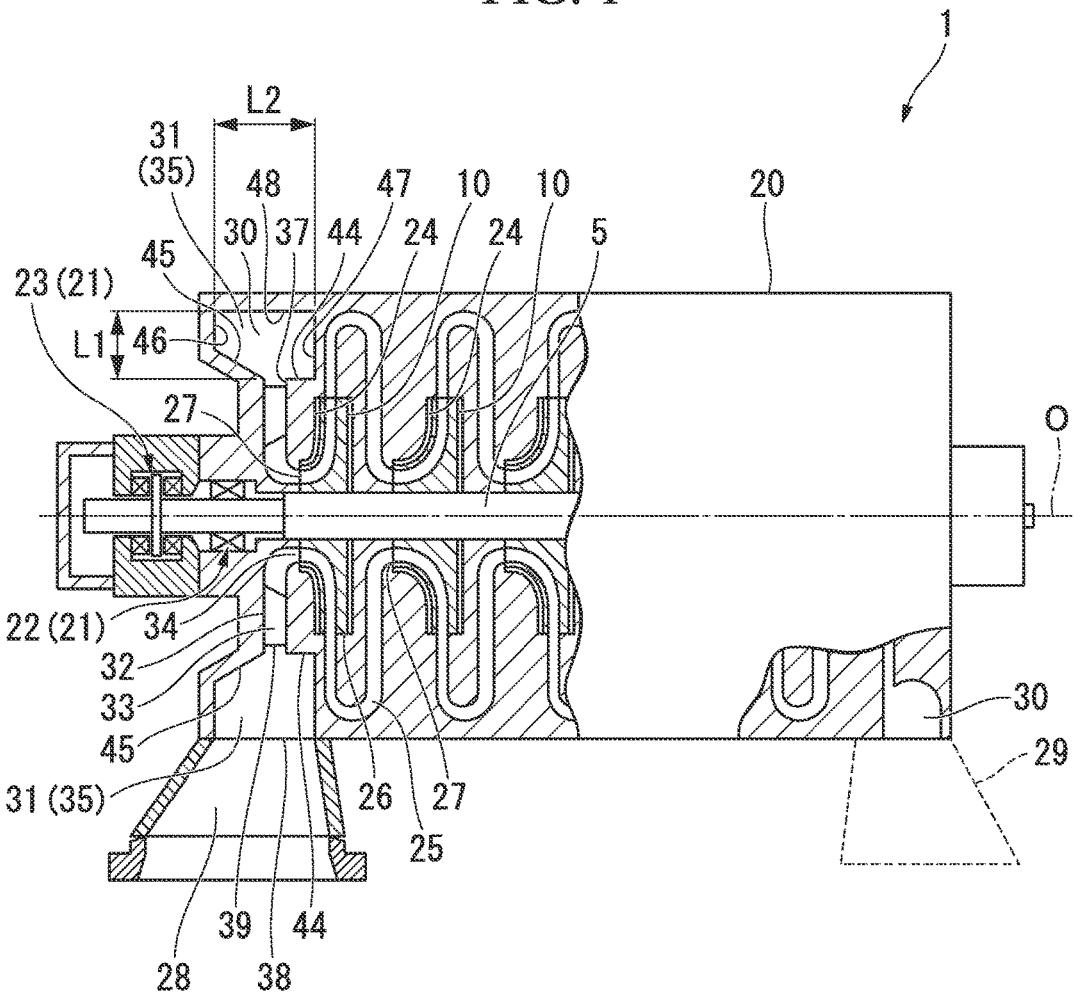
FIG. 1 is a view showing the entire configuration of a centrifugal compressor according to an embodiment of the present invention.

FIG. 1 is a general view showing a schematic configuration of a centrifugal compressor, which is the rotary machine of the embodiment.

As shown in FIG. 1, a centrifugal compressor 1 of the embodiment is mainly constituted by a rotary shaft 5 rotated about an axis O, an impeller 10 attached to the rotary shaft 5 and configured to compress a gas G, which is a fluid, using a centrifugal force, and a casing 20 configured to rotatably support the rotary shaft 5.

The casing 20 is formed to configure a substantially cylindrical outline, and the rotary shaft 5 is disposed to pass through a center thereof. Bearings 21 are installed at one side section and the other side section of the casing 20 in the axis O direction of the rotary shaft 5. That is, the rotary shaft 5 is rotatably supported by the casing 20 via the bearing 21. Here, as the bearings 21, a journal bearing 22 configured to support the rotary shaft 5 in the radial direction and a thrust bearing 23 configured to support the rotary shaft 5 in the axial direction are installed.

A plurality of impellers 10 are attached to the rotary shaft 5 in the axis O direction. In addition, a plurality of accommodating chambers 24 configured to accommodate the impeller 10 are formed in the casing 20. The accommodating chambers 24 is formed to be slightly larger than the impeller 10 along an outer surface of the impeller 10, and forms an inner space having a diameter gradually increasing toward a downstream side (a right side of the drawing) and then reduced. Further, in FIG. 1, while an example in which the plurality of impellers 10 are installed is shown, at least one impeller 10 may be installed. In addition, in the following description, the left side of the drawing in the axis O direction is referred to as an upstream side, and the right side of the drawing is referred to as a downstream side.

An ejection passage 25 configured to guide the gas G ejected from the impeller 10 of the upstream side in the axis O direction to the impeller 10 of the downstream side in the axis O direction is formed between the accommodating chambers 24. The ejection passage 25 is formed in an annular shape around the axis O. In addition, the ejection passage 25 is formed in a substantially U shape when seen in a cross-sectional view to guide the gas G ejected from an outlet opening section 26 of the accommodating chamber 24 disposed at the upstream side in the axis O direction to an inlet opening section 27 of the accommodating chamber 24 of the downstream side in the axis O direction.

A discharge nozzle 29 configured to discharge the gas G is attached to the downstream side in the axis O direction of the casing 20. The discharge nozzle 29 is connected to a discharge volute 30 in communication with the accommodating chamber 24 of the most downstream side in the axis O direction of the casing 20 and discharges the gas G compressed by the impeller 10 of each stage to the outside of the casing 20.

A substantially cylindrical suction nozzle 28 configured to introduce the gas G from an outer circumferential side to an inner circumferential side in the radial direction of the casing 20 and having a diameter increasing as it goes toward the outer circumferential side is attached to the upstream side in the axis O direction of the casing 20. Further, a suction volute 31 in communication with the suction nozzle 28 disposed at the inner circumferential side in the radial direction of the suction nozzle 28 is formed at the casing 20. A guide section 32 configured to connect the suction volute 31 and the inlet opening section 27 of the accommodating chamber 24 of the most upstream side is formed at the inner circumferential side of the suction volute 31.

The guide section 32 forms a substantially annular first flow path 33 in communication with an inner space 35 of the suction volute 31 at the inner circumferential side of the suction volute 31 and extends toward the inner circumferential side, and a substantially cylindrical second flow path 34 extending from the inner circumferential side of the first flow path 33 toward the downstream side along the axis O. The second flow path 34 comes in communication with the inlet opening section 27 of the accommodating chamber 24 of the most upstream side at the downstream side in the axis O direction. The guide section 32 has a width dimension in the axis O direction of the first flow path 33 smaller than that in the axis O direction of the suction volute 31.

Figure 2:
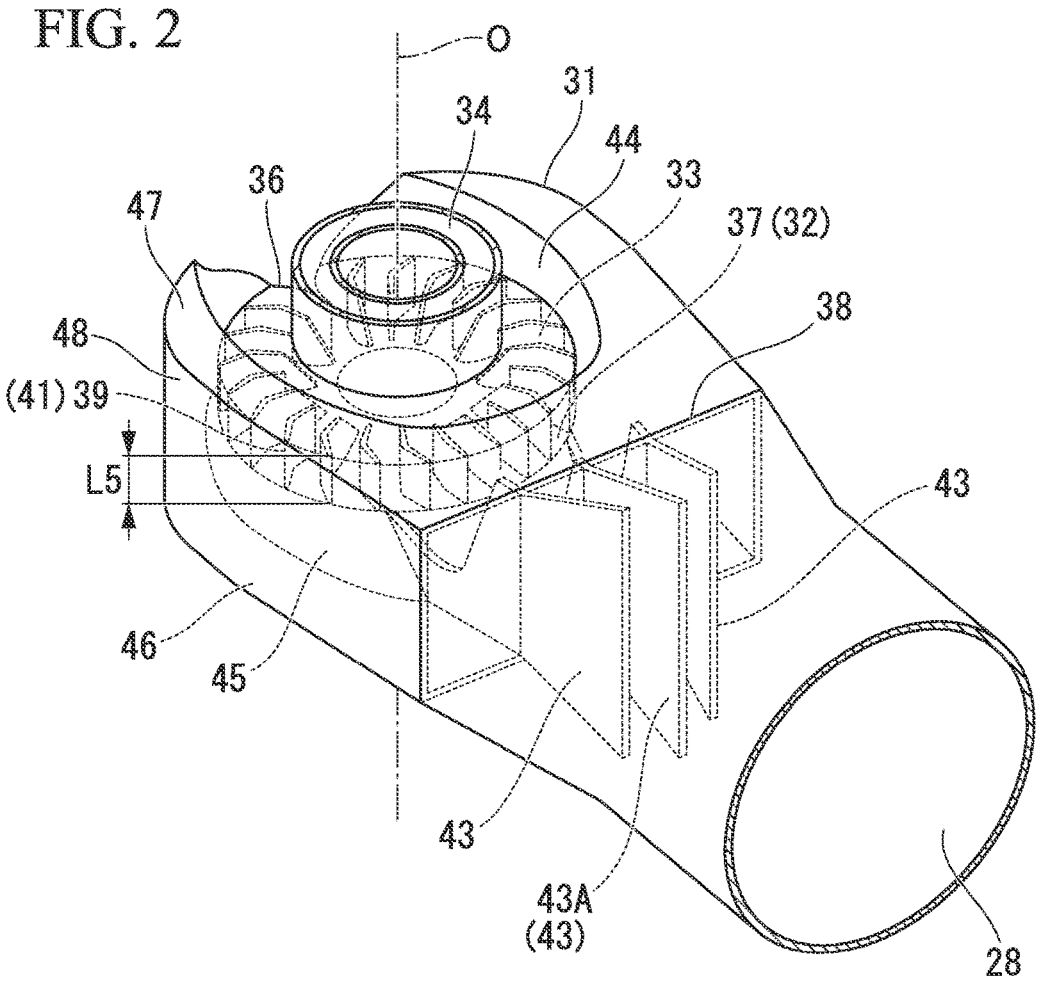
FIG. 2 is a perspective view of a suction volute of the centrifugal compressor according to the embodiment.
Figure 3:
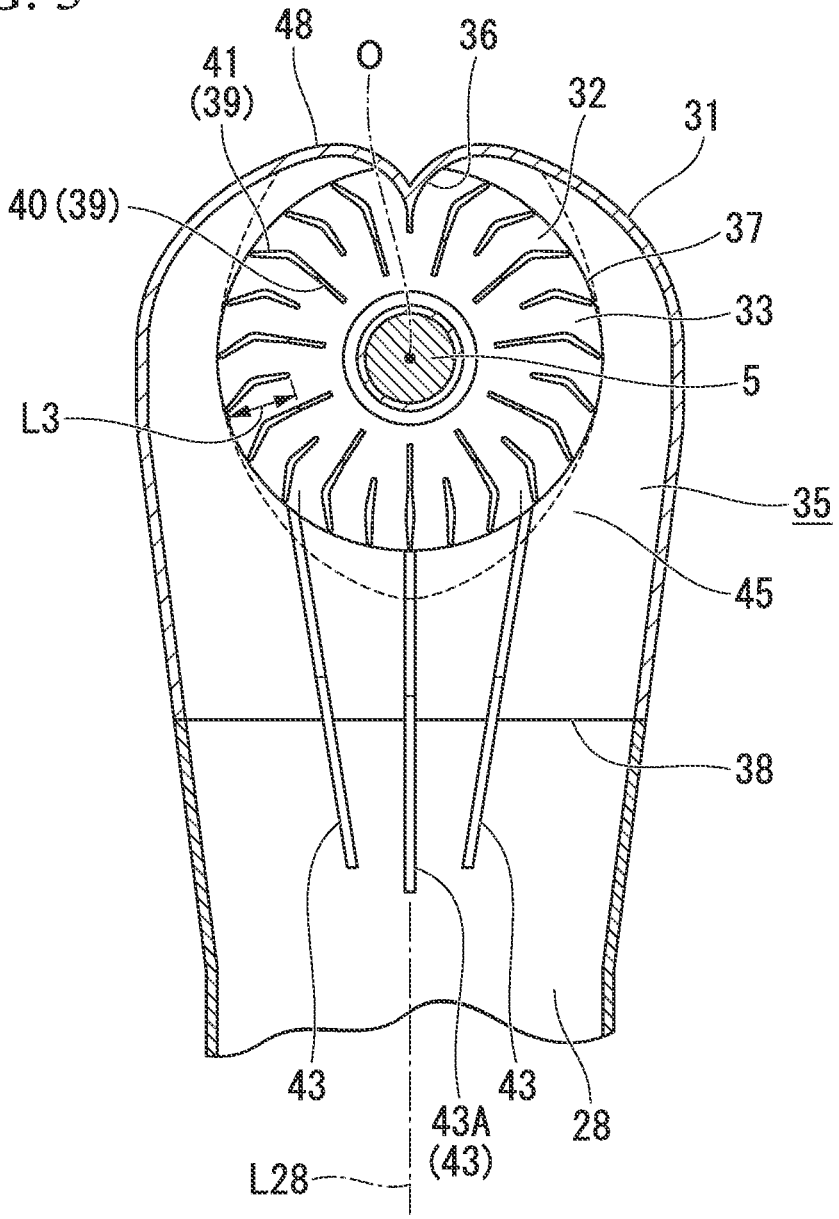
FIG. 3 is a horizontal cross-sectional view of the suction volute according to the embodiment.

FIG. 2 is a perspective view of a periphery of the suction volute 31, and FIG. 3 is a cross-sectional view of the periphery of the suction volute 31.

As shown in FIGS. 2 and 3, the inner space 35 of the suction volute 31 is formed in a substantially annular shape (see FIG. 3) to surround the guide section 32 in the circumferential direction. Then, the suction volute 31 includes a substantially annular opening section 37 in communication with the guide section 32 at the inner circumferential side.

In addition, the suction volute 31 has a partition section 36 configured to separate the inner space 35 in the circumferential direction from a connection section 38 connected to the suction nozzle 28 at an opposite side thereof with the axis O sandwiched therebetween (a position deviated to about 180 degrees in the circumferential direction about the rotary shaft 5). Then, the suction volute 31 has a dimension in the radial direction of the inner space 35 which gradually decreases as it approaches the partition section 36 in the circumferential direction.

A plurality of vanes 39 configured to guide the gas G flowing in the circumferential direction of the suction volute 31 toward the second flow path 34 are disposed at the first flow path 33 of the guide section 32. These vanes 39 include inner circumferential vanes 40 vertically installed at the inner circumferential side in the axis O direction toward the second flow path 34 in the radial direction, and outer circumferential vanes 41 vertically installed at the outer circumferential side than the inner circumferential vane 40 and slightly angled toward the suction nozzle 28. The outer circumferential vanes 41 are also disposed at an intermediate position of the inner circumferential vanes 40 in the circumferential direction. Further, the above-mentioned partition section 36 has a shape such that the end section of the inner circumferential side in the radial direction functions as the outer circumferential vane of the first flow path 33.

Nozzle-inside partition plates 43 configured to guide the gas G introduced from the suction nozzle 28 in the radial direction to flow in the circumferential direction are disposed at the suction nozzle 28 and the suction volute 31. In the embodiment, three nozzle-inside partition plates 43 are installed, and a nozzle-inside partition plate 43A of a center extends in the radial direction along the central axis L28 of the suction nozzle 28. In addition, the two nozzle-inside partition plates 43 on both sides of the nozzle-inside partition plate 43A extend such that an interval of the two nozzle-inside partition plates 43 is gradually increased from the suction nozzle 28 side toward the guide section 32. Further, the configuration of the nozzle-inside partition plates 43 is not limited to that of the embodiment, for example, four or more nozzle-inside partition plates 43 may be provided and may extend to the inside of the suction nozzle 28.

The suction volute 31 has an inner wall surface 44 extending from the opening section 37 toward the impeller 10 in the axis O direction along the axis O to increase a width dimension in the axis O direction (see FIGS. 1 and 2). The inner wall surface 44 is formed along the opening section 37 and connected to the partition section 36 at an opposite side from the connection section 38 with the axis O interposed therebetween. The width dimension in the axis O direction of the inner wall surface 44 is substantially the same dimension throughout the entire circumference thereof.

Meanwhile, a tapered section 45 including an inclined surface inclined outward in the radial direction is formed at an opposite side of the inner wall surface 44 in the axis O direction with the opening section 37 sandwiched therebetween. Wall surfaces 46 and 47 in the axial direction extending outward in the radial direction are connected to an end edge of the outer circumferential side in the radial direction of the tapered section 45 and an end edge of the downstream side in the axial direction of the inner wall surface 44. That is, the suction volute 31 is formed to be widened at both sides in the axial direction with respect to the opening section 37. Then, as the tapered section 45 is formed, the width dimension in the axis O direction of the suction volute 31 is gradually reduced toward the opening section 37.

The wall surfaces 46 and 47 in the axial direction have the width dimension at the partition section 36 side gradually reduced as they approach the partition section 36 in the circumferential direction. Similarly, the inner wall surface 44 also has a dimension in the axis O direction gradually reduced in immediate front of the partition section 36 and is connected to the partition section 36. Then, an outer circumferential surface 48 configured to connect the wall surfaces 46 and 47 in the axial direction and extending in the axial direction is formed outside in the radial direction of the wall surfaces 46 and 47 in the axial direction.

The outer circumferential surface 48 is connected to the partition section 36 at an opposite side from the connection section 38 with the axis O interposed therebetween. Specifically, the outer circumferential surface 48 is formed to be curved toward the inner circumferential side in the radial direction and extended to the partition section 36 at the partition section 36 side in the circumferential direction (see FIG. 3). Introduction of the gas G from the suction volute 31 into the guide section 32 at the partition section 36 side can be more smoothly guided by the outer circumferential surface 48.

Next, an action of the rotary machine 1 according to the embodiment, in particular, an action until the gas G introduced from the suction nozzle 28 enters the inlet opening section 27 will be described.

As shown in FIGS. 1 and 2, in the casing 20 of the embodiment, the gas G flowing from the outer circumferential side in the radial direction to the inner circumferential side by the suction nozzle 28 flows from the connection section 38 into the suction volute 31. Here, as the three nozzle-inside partition plates 43 are installed, the gas G introduced into the suction volute 31 can be guided to both sides in the circumferential direction to appropriately flow in the circumferential direction. Then, the gas G flowing in the circumferential direction of the suction volute 31 gradually flows into the guide section 32 disposed at the inner circumferential side, is changed to a flow in the axial direction by the guide section 32, and flows to the inlet opening section 27 of the impeller 10.

Accordingly, according to the centrifugal compressor 1 of the above-mentioned embodiment, as the suction volute 31 has the inner wall surface 44 extending from the opening section 37 toward the impeller 10 in the axis O direction along the axis O to increase the width dimension in the axis O direction, for example, when the dimension in the radial direction of the casing 20 is reduced, the width dimension of the suction volute 31 can be increased toward the impeller 10 in the axis O direction. For this reason, an increase in flow velocity of the gas G introduced from the suction nozzle 28 can be suppressed throughout the entire region of the suction volute 31 from the suction nozzle 28 side to the partition section 36. For this reason, an increase in pressure loss due to an occurrence of exfoliation or the like in the gas G flowing into the guide section 32 can be prevented. As a result, a degradation in performance can be suppressed.

In addition, since the width dimension of the axis O direction of the suction volute 31 can be increased at both sides in the axis O direction to be larger than that of the opening section 37, the flow path area can be further increased in comparison with the case in which only one side in the axis O direction is increased. As a result, an increase in the flow velocity of the gas G introduced into the suction volute 31 can be more reliably prevented.

Further, as the tapered section 45 is formed at the suction volute 31, since the flow velocity of the gas G flowing from the suction volute 31 into the opening section 37 can be gradually increased on an opposite side of the impeller 10 in the axis O direction, the gas G can be smoothly guided to the guide section 32.

In addition, as the tapered section 45 is provided, protrusion of the suction volute 31 toward the outside in the axis O direction (an opposite side of the impeller 10) can be suppressed. That is, since an increase in size of the centrifugal compressor in the axis O direction can be prevented, it is advantageous in the case in which no space is provided in the axis O direction, for example, in the case in which a pipe or the like is disposed on the outside in the axis O direction of the suction volute 31.

Further, the present invention is not limited to the configuration of the above-mentioned embodiment but design changes may be made without departing from the spirit of the present invention.

Figure 4:
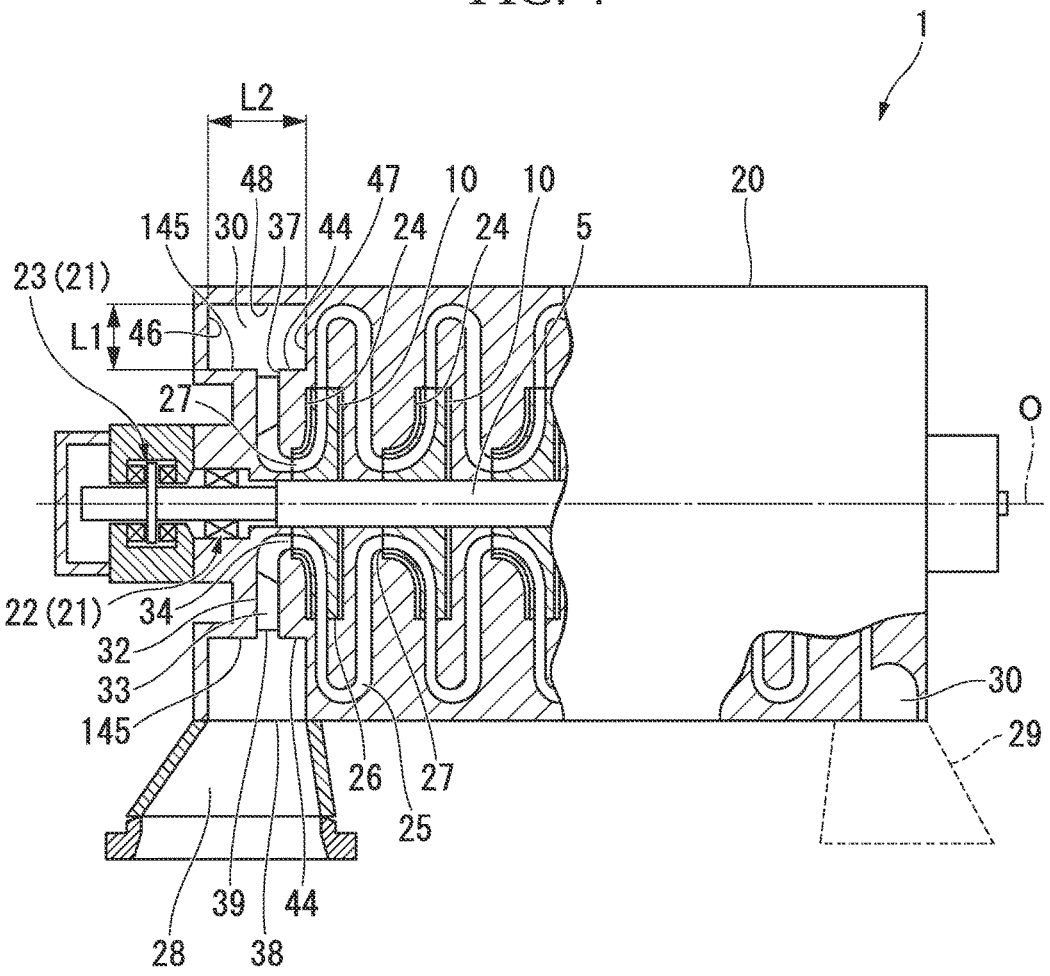
FIG. 4 is a view showing the entire configuration according to a variant of the embodiment corresponding to FIG. 1.

For example, in the above-mentioned embodiment, while the case in which the suction volute 31 has the tapered section 45 has been described, when there is a spatial margin at the outside in the axis O direction of the suction volute 31 (an opposite side of the impeller 10), for example, as shown in FIG. 4, instead of the tapered section 45, an inner wall surface 145 extending to the outside of the impeller 10 may be formed along the axis O.

According to the above-mentioned configuration, since the dimension in the axis O direction of the suction volute 31 can also be increased at an opposite side of the impeller 10 in the axis O direction, the flow path cross-sectional area can be further increased. As a result, an increase in flow velocity of the gas G introduced from the suction nozzle 28 can be further suppressed to reduce the pressure loss.

In addition, in the above-mentioned embodiment, the flow path area of the suction volute 31 may be 90% or more with respect to the flow path area of the suction nozzle 28. As a result, an abrupt increase in the flow velocity of the gas G introduced from the suction nozzle 28 into the suction volute 31 can be prevented. Meanwhile, when the flow path area of the suction volute 31 is less than 90%, the flow velocity of the gas G in the suction volute 31 is increased more than in the case when the flow path area of the suction volute 31 is 90% or more, and the pressure loss may be increased due to exfoliation or the like in the guide section 32.

Further, a width L3 in the radial direction of the outer circumferential vane 41 may be set to a range of 90% to 110% with respect to a dimension L1 in the radial direction of the suction volute 31.

Here, in the related art, while the width L3 in the radial direction of the outer circumferential vane 41 is set to about 110 to 180% of the inner diameter of the suction nozzle 28, for example, when the diameter of the casing 20 is set to 80% at a ratio of the suction nozzle of the related art, the width L3 of the outer circumferential vane 41 may be further set to about 90% with respect to about the above 110 to 180%.

Further, in the related art, while a width L5 in the axial direction of the outer circumferential vane 41 is set to about 15 to 25% of the inner diameter of the suction nozzle 28, for example, when the diameter of the casing 20 is set to 80% at a ratio of the suction nozzle of the related art, the width L5 in the axial direction may be further set to about 75% with respect to about the above 15 to 25% of the outer circumferential vane 41.

As a result, the flow path area of the first flow path 33 of the guide section 32 can be optimized with respect to the flow path area of the suction volute 31. As a result, in comparison with the width L3 in the radial direction of the outer circumferential vane 41 or the width L5 in axial direction of the vane 39, set to the above-mentioned range, since an abrupt increase in flow velocity when the gas G is introduced from the opening section 37 into the guide section 32 can be prevented, the pressure loss due to the exfoliation or the like in the guide section 32 can be further reduced.

Figure 5:
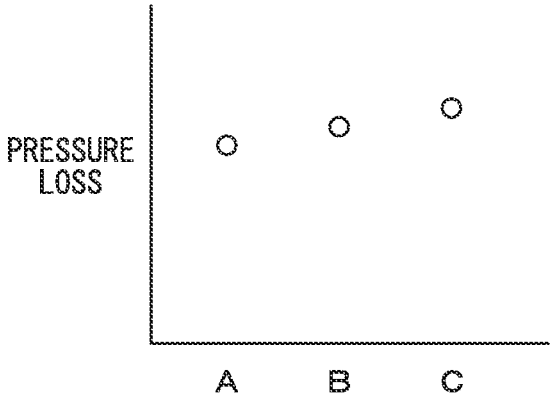
FIG. 5 is a graph of pressure loss of various conditions in the suction volute.

FIG. 5 is a graph showing the pressure loss when the diameter of the casing 20 is set to about 80% with reference to the centrifugal compressor of the related art. "A" represents the case in which only the inner wall surface 44 is formed, and "B" represents the case in which the width L3 in the radial direction of the outer circumferential vane 41 is set to 90 to 110% with respect to the dimension L1 in the radial direction of the suction volute 31 in addition to the condition of "A." Further, "C" represents the pressure loss in the case of the centrifugal compressor (the diameter of 100%) of the related art.

That is, even in the above-mentioned configuration of the inner wall surface 44 of the suction volute 31, while the same performance as in the case of the diameter of 100% can be obtained, as conditions such as the shape of the suction volute 31, the shape of the vane 39, disposition of the nozzle-inside partition plate 43, and so on, are optimized, the pressure loss can be further reduced.

In addition, in the above-mentioned embodiment, while the centrifugal compressor 1 serving as the rotary machine has been described as an example, the embodiment may also be applied to the rotary machine such as a radial-flow turbine or the like.

REFERENCE SIGNS LIST

10 impeller
28 suction nozzle
31 suction volute
32 guide section
33 first flow path
37 opening section
39 vane
44 inner wall surface
45 tapered section
145 inner wall surface

The invention claimed is:

1. A rotary machine comprising:

a casing;

a nozzle configured to introduce a fluid from an outer circumferential side of the casing to an inner circumferential side of the casing in a radial direction;

a volute having a space in communication with the nozzle at the outer circumferential side;

a guide section having a first flow path in communication with the volute at an inner circumferential side of the volute, and a second flow path extending from an inner circumferential side of the first flow path toward a downstream side of the casing along a central axis, and configured to guide the fluid introduced from the volute; and an impeller connected to the guide section in an axial direction into which the fluid guided by the guide section is introduced, wherein the volute comprises:

an annular opening section in communication with the guide section at an inner circumferential side of the space of the volute; and an inner wall surface extending from the annular opening section to a same position, with respect to the axial direction, as a position of a first portion of the impeller in the axial direction, thereby increasing a width dimension along the central axis, wherein the first portion of the impeller is a part at a most upstream side of the casing in the axial direction among parts of the impeller, at a side opposite from a connection section with the central axis sandwiched therebetween, of which a dimension in the axial direction gradually decreases, a plurality of vanes are installed at the first flow path of the guide section and extend toward the second flow path, the plurality of vanes comprises:

first vanes, each having an inner circumferential vane and an outer circumferential vane connected to each other; and second vanes, installed at positions different from those of the first vanes in a circumferential direction, and each second vane only having an outer circumferential vane which is the same cross-sectional profile as the outer circumferential vane in the each of the first vanes, the inner circumferential vanes of the first vanes are disposed nearer to the second flow path than the outer circumferential vanes of the first vanes and the second vanes, and a height of the first vanes along the central axis is the same as that of the second vanes.

2. The rotary machine according to claim 1, wherein the inner wall surface extending from the annular opening section extends to an opposite side, with respect to the axial direction, of a position at which the impeller is located in the axial direction, thereby increasing the width dimension along the central axis.

3. The rotary machine according to claim 1, wherein the impeller includes a plurality of the impellers disposed in the axial direction, and the rotary machine further comprising:

an upstream side impeller of the plurality of the impellers in the axial direction;

a downstream side impeller of the plurality of impellers in the axial direction; and an ejection passage configured to guide the fluid ejected from the upstream side impeller to the downstream side impeller, wherein the volute further comprises an outer circumferential surface configured to extend in the axial direction, and wherein the outer circumferential surface and an outermost portion of a circumferential side in a radial direction of the ejection passage are located at the same position in the radial direction.

4. The rotary machine according to claim 2, wherein the impeller includes a plurality of the impellers disposed in the axial direction, and the rotary machine further comprising:

an upstream side impeller of the plurality of the impellers in the axial direction;

a downstream side impeller of the plurality of the impellers in the axial direction; and an ejection passage configured to guide the fluid ejected from the upstream side impeller to the downstream side impeller, wherein the volute further comprises an outer circumferential surface configured to extend in the axial direction, and wherein the outer circumferential surface and an outermost portion of a circumferential side in a radial direction of the ejection passage are located at the same position in the radial direction.

* * * * *